United States Patent [19]

Tassone

[11] Patent Number: 4,863,158

[45] Date of Patent: Sep. 5, 1989

[54] SIT-UP EXERCISE AID

[76] Inventor: Daniel R. Tassone, 4486 Makyes Rd., Syracuse, N.Y. 13215

[21] Appl. No.: 222,795

[22] Filed: Jul. 22, 1988

[51] Int. Cl.[4] ..... A63B 23/02; A63B 13/00

[52] U.S. Cl. ..... 272/93; 272/123

[58] Field of Search ..... 272/93, 116, 117, 122, 272/123, 124, 125, 126, 143

[56] References Cited

U.S. PATENT DOCUMENTS

| | | | |
|---|---|---|---|
| 3,049,130 | 8/1962 | Fuschetti . | |
| 3,370,850 | 2/1968 | Moore . | |
| 3,612,042 | 10/1971 | Fry | 272/93 X |
| 3,679,107 | 7/1972 | Perrine . | |
| 3,820,781 | 6/1974 | Kane . | |
| 4,257,591 | 3/1981 | Evans, Sr. | 272/93 X |
| 4,274,628 | 6/1981 | Hoagland | 272/123 |
| 4,296,924 | 10/1981 | Anzaldua et al. | 272/117 |
| 4,440,391 | 4/1984 | Saenz, Jr. et al. | 272/93 |
| 4,518,162 | 5/1985 | Oates | 272/93 |
| 4,623,146 | 11/1986 | Jackson | 272/137 |
| 4,722,524 | 2/1988 | Waszkelewicz | 272/123 |
| 4,770,414 | 9/1988 | Fredrickson et al. | 272/126 |

*Primary Examiner*—Richard J. Apley
*Assistant Examiner*—Robert W. Bahr
*Attorney, Agent, or Firm*—Wall and Roehrig

[57] ABSTRACT

A sit up exercise bar is employed to add resistance for sit up exercises, and positions the subject's hands and arms so as to produce a fluent motion, reducing stresses on the lower back. The sit up bar has yoke form of a pair of aligned straight sections and a central neck bow which curves behind the subject's neck. A pair of handles extend forward from the respective straight sections. These position the subject's hands in front of the shoulders or particularly, a few inches in front of the anterior deltoid.

12 Claims, 2 Drawing Sheets

SIT-UP EXERCISE AID

BACKGROUND OF THE INVENTION

This invention relates to exercise devices and is more particularly directed to devices which assist persons during exercise in maintaining a correct position throughout the movement of the exercise, so as to maximize the benefits of exercise and to avoid risk of pain or injury.

This invention is more specifically directed to an exercise bar which is used in a sit up exercise and can also be used to add resistance to sit-ups. The exercise bar can also be used to add resistance in other exercises, such as lower back extensions, radial deviation flexions, or trunk rotations.

The conventional techniques for sit-ups are so-called straight by sit-ups and hands-behind-neck sit ups. Both exercises are intended to strengthen the abdominal muscles, but both are contraindicated movements because of the abnormal stress that they place on the lower back. Straight-leg sit ups can lead to lower back injury or strain, and should not be performed. This exercise abnormally contracts the hip flexors primarily the ileopsas muscles. This pulls the lumbar spine into an abnormal curve. This may be avoided only if the lower back is maintained in a flattened position throughout the movement, but that is not possible with this exercise as it is usually performed. The hands-behind-neck sit-ups exercise should also be avoided. In this position not only is there a risk of lumbar spine injury, but the cervical spine can be adversely stressed.

Recommended exercises for conditioning the abdominal muscles include the abdominal curl and advanced abdominal curl. In the former, the subject person exercising lies supine with knees bent and feet on the floor, and with the hands clasped across the chest. The subject then curls, or rolls the upper trunk and head upward towards the knees, then returns to the starting position. Advanced abdominal curls are similar, but the subject holds a weight bar or dumbbell on the chest during the movement. Both of these have the advantage that the lower back remains on the floor during the initial phase of the movement.

However, because the hands are at the chest, arm movement is extremely limited. The arms and shoulders cannot roll downward below the thorax during the movement, so abdominal muscle stress is limited only to the first few degrees of motion.

There have been a number of exercise bars and similar devices proposed as aids in performing various exercises, but none of these is suited as an aid in doing sit-ups. Among these devices are an exercise shaft for torso twist exercise, U.S. Pat. No. 3,820,781; weight support bars for knee bends, U.S. Pat. Nos. 4,274,628 and 3,370,850; and a weight bar with sliding weight tube for exercising various abdominal and dorsal muscle groups, U.S. Pat. No. 4,623,146. However, the inventor is unaware of any devices for properly positioning the subject for sit up exercises, so that the subject's lower back is kept flattened throughout the movement, avoiding strain or injury to the lumbar spine.

OBJECTS AND SUMMARY OF THE INVENTION

It is an object of this invention to provide an exercise aid for sit ups which positions the subject properly to avoid lower back stresses during the sit-up movement.

It is another object to provide a sit-up bar which can add resistance for a sit-up movement.

It is yet another object of this invention to provide an exercise aid which is simple to use, with few moving parts.

According to one aspect of this invention the exercise aid comprises a yoke that has an arcuate neck bow and straight portions that extend in a line from left and right sides of the neck bow. The neck bow curves behind the subject's neck. A pair of handle tubes extend forward from the left and right straight portions, respectively, and these are gripped with subject's hands just to the left and right of the torso and slightly in front of the deltoids. This positions the upper arms with the elbows pointing generally down (i.e., slightly in front of the abdomen). In this position, the lower back stays flat against the floor as the subject rises, stressing the abdominal muscles without strain to the lower spine. After the initial phase, the back is lifted off the floor by the hip flexors, but the lower back remains flat. The elbows and arms can move down during the movement because the bar is permitted to roll. This extends the range of motion for the abdominal muscles beyond what is possible, for example, with abdominal curls.

The sit-up bar can have weight collars on the straight portions to hold weight discs for added resistance. In certain embodiments the spacing between the handle tubes can be adjusted. For most persons the spacing should be set somewhere between about 18 to 24 inches.

The above and other objects, features and advantages of this invention will become apparent from the ensuing description of a preferred embodiment, which is explained in connection with the accompanying drawing.

DETAILED DESCRIPTION OF THE PREFERRED EMBODIMENT

Figure 1:
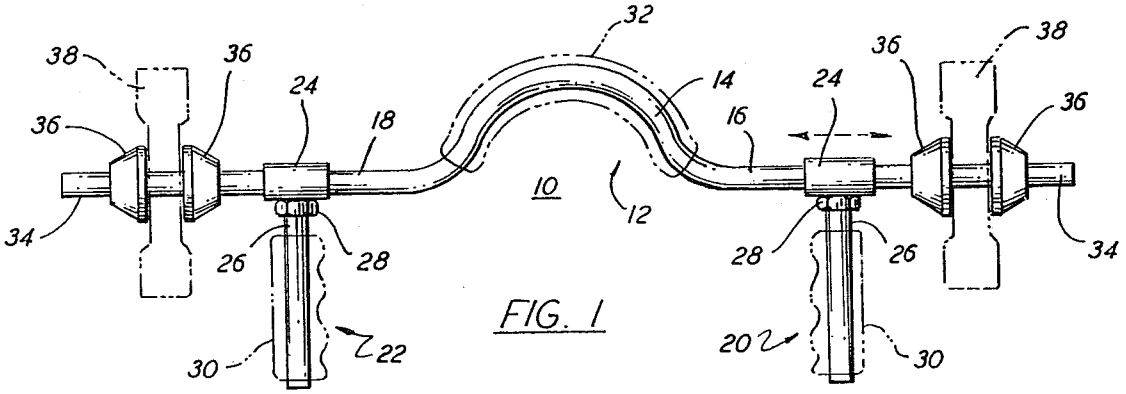
FIG. 1 is a plan view of a sit up exercise bar according to another embodiment of this invention.

With reference to the Drawing, and initially to FIG. 1, a sit up bar 10 according to one embodiment of this invention comprises a yoke 12, formed of a neck bow 14 at the center, which arcs around behind the subject's neck, and left and right straight sections or bar portions 16, 18 which extend in a line from the ends of the neck bow 14. A left handle assembly 20 nd a right handle assembly 22 each extend forward from the straight sections 16 and 18, respectively, for positioning the subject's hands forward of the front part of the chest, and just below the shoulders. Here the neck bow has a radius on the order of about four inches.

In this embodiment, each of the handle assemblies 20 and 22 comprises a sleeve 24 which slidably overfits the respective straight section 16, 18, and a handle tube 26 that extends forward at right angles to the associated straight section 16, 18. A setting knob 28 on each handle assembly is turned in one direction to loosen the sleeve 24 and in the other direction to tighten it. This permits adjustment of the spacing between the handle assemblies to suit the individual. For most persons, this spacing can be between about 18 and 24 inches, nominally 22 inches.

Grips 30 of a soft plastic or rubber-like resilient material can optionally be included over the handle tubes 26, and an optional neck comfort pad 32 can be removably disposed over the neck bow 14 of the yoke. Preferably, this is secured with Velcro fasteners in a known fashion.

Extension portions 34 of the left and right straight sections 16, 18 protrude beyond the respective handle assemblies 20 and 22, and these can be used to carry additional weights, in the manner of a weight bar or bar bell. For this reason, weight collars 36 can be provided on these extension portions 34 for securing weight discs 38, illustrated in ghost.

Figure 2:
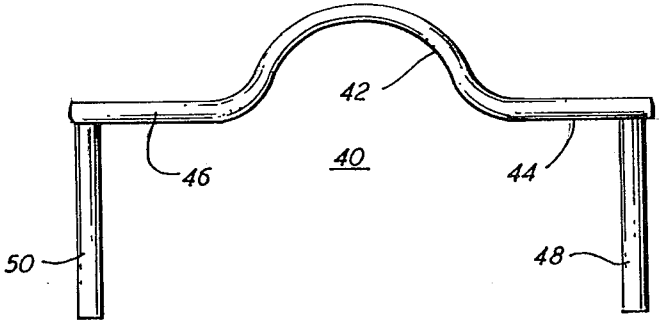
FIG. 2 is a sit up exercise bar according to one preferred embodiment of this invention.
Figure 3A:
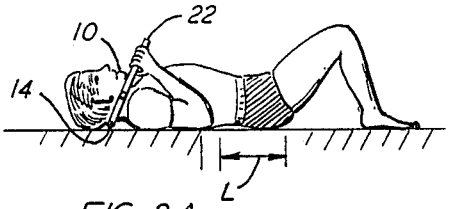
FIGS. 3A and 3B are side and rear views respectively showing the human subject in the supine starting position.
Figure 3B:
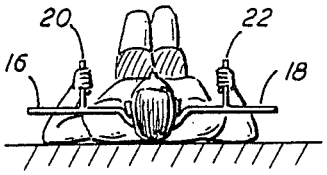

Another, alternative embodiment is illustrated by the sit up bar 40 in FIG. 2. Here the sit up bar is a simple, tubular, one-piece structure comprising a neck bow 42, aligned straight sections 44 and 46, and straight handle tubes 48 and 50 that protrude forward from the ends of the straight sections 44 and 46. This unitary assembly is of a light weight, tubular material, such as aluminum, stainless steel, or a durable plastic resin. The tubular material can be filled with lead shot or other heavy matter for adding resistance. This sit up bar 40 serves to position the hands and arms for sit ups, i.e., to position the athlete or other subject so as to maintain the lumbar region of the back flat over the sit up movement.

Figure 4A:
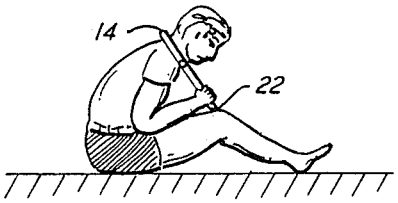
FIGS. 4A and 4B are side and rear views, respectively, showing the subject in the sitting position.
Figure 4B:
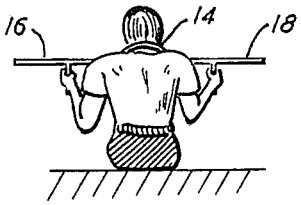

The manner of using the sit up bar 10 or 40 is illustrated in FIGS. 3A, 3B, 4A, and 4B. Initially, the subject is lying in the supine position, with hands on the handle assemblies 20, 22, and with the neck bow 14 of the yoke passing behind his or her neck. Preferably, the knees are bent and the feet are flat on the floor. At this stage, the lumbar region L is flattened, and is completely supported on the floor. In performing this sit up movement, the subject brings himself or herself to the sitting position, as shown in FIG. 4A and FIG. 4B. With the upper arms generally oriented downwards and along the subject's thorax, the stress is placed entirely on the abdominal muscles, and the lumbar region L remains flattened for the initial phase of the movement. Then, the hip flexors bring the hips and torso to the sitting position of FIGS. 4A and 4B, all the time maintaining the lumbar region L in a generally flattened position.

The advantages of this can be explained with reference to FIGS. 5, 6, and 7.

Figure 5:
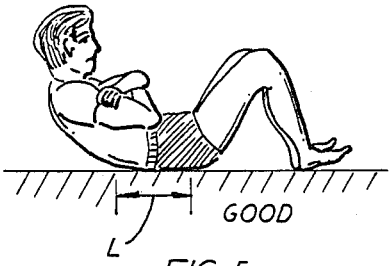
FIG. 5 Prior Art
FIGS. 5 and 6 are side views of a subject performing the movement of an abdominal curl and a conventional sit-up, respectively.

An abdominal curl exercise is illustrated in FIG. 5. Here the subject has his arms crossed over the chest. This positions the arms and shoulders so that the lumbar region L remains flat on the floor as the abdominal muscles pull the subject through the movement. This particular exercise is recommended as it does not put much unsupported strain on the lower back. However, the range of movement is rather limited, and it is difficult for the subject to add resistance, as the hands must remain on the chest.

Figure 6:
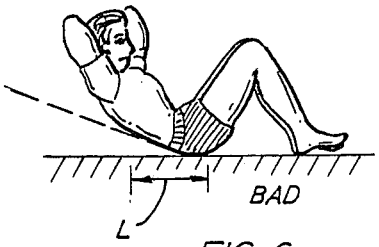
FIG. 6 Prior Art

A conventional sit up, with arms behind head, is illustrated in FIG. 6. Here, at the beginning of motion, the subject's back is already lifting off from the floor. This places large unsupported stresses on the lower spine, and can cause strain and injury to the lower back. Consequently, this is a contra-indicated exercise.

Figure 7:
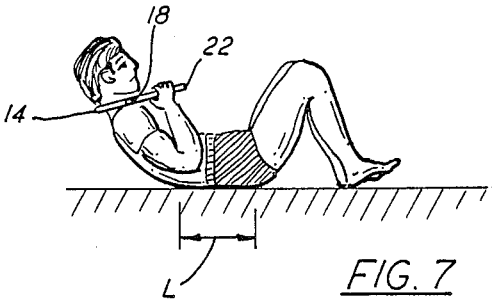
FIG. 7 is a side view illustrating a subject performing the corresponding sit up movement employing the exercise bar of this invention.

FIG. 7 illustrates the subject performing a sit up employing the sit up exercise bar 10. The hands and arms are positioned so that jerky motion is avoided, and the lower back or lumbar region L stays flat throughout the first phase of the movement. After this first phase, the abductor muscles of the leg that are responsible for motion to raise the entire torso from the hips, so that the back remains flat as the subject is pulled up to the sitting position of FIGS. 4A and 4B.

When using the sit up bar 10 or 40 for sit ups, the subject is in a more efficient and anatomically comfortable position. The arms are adducted and the elbows flexed because of the position of the hands gripping the handles of the bar. The hands are maintained about nine inches in front of th anterior deltoid. In this position, the subject's back is straight to slightly rounded, and the shoulders are also in a rounded position. This allows the subject to initiate the first thirty degrees of the sit up with the abdominal muscles only, which in return will cause the sit up to be a more smooth, fluent motion, and thus reduce the pressure on the lower back. That pressure is often due to a jerking motion when sit ups are done with the hands behind the head.

In addition to its utility in performing in sit ups, the exercise aid of this invention can also be used to add resistance to lower back extensions, trunk rotation exercises, and wrist exercises, such as radial deviation and flexion.

While this invention has been described in detail with respect to certain preferred embodiments, it should be understood that the invention is not limited to those precise embodiments. Rather, many modifications and variations would present themselves to those skilled in the art without departing from the scope and spirit of this invention, as defined in the appended claims

I claim:

1. An exercise aid for assisting a human subject in performing a sit-up movement so as to avoid risk of strain or injury to the subject's lower back by positioning the subject's arms and shoulders to maintain the lower back in a flattened position throughout the movement, comprising a yoke that includes a pair of aligned, laterally extending bar portions that extend respectively beyond the subject's shoulders and neck bow connecting inner ends of said bar portions and curving to pass behind the subject's neck; and a pair of handle members rigidly secured on the respective bar portions at positions separated from one another by a distance slightly greater than the distance across the subject's shoulders, and extending forwardly in a direction generally opposite to that of the neck bow a distance in front of the front plane of the subject's chest, to be gripped by the subject's hands when his or her arms are positioned alongside his or her trunk, said distance being sufficient to position the subject's hands in front of the front plane of the subject's chest during a sit-up movement.

2. The exercise aid of claim 1 wherein said yoke is unitarily formed as a tubular member.

3. The exercise aid of claim 1 wherein said handle members are tubular members extending at substantially right angles to the associated lateral bar portions.

4. The exercise aid of claim 3 wherein said handle members each include a grip of a resilient material.

5. The exercise aid of claim 1 wherein said handle members each include means for slidably moving the handle members on the associated bars to permit adjustment of the distance between the handle members.

6. The exercise aid of claim 5 wherein said means for moving the handle members include adjustment knobs for releasably locking the handle members along the associated lateral bar portions.

7. The exercise aid of claim 5 further comprising a comfort pad disposed over at least a portion of said arcuate neck bow.

8. The exercise aid of claim 1 wherein said bar portions include weight bars that extend laterally beyond said handle portions, and further comprising inner and outer weight-disc-retaining collars disposed on each of said weight bars for permitting standard weight discs to be held on said weight bars between said collars during a sit-up movement.

9. The exercise aid of claim 1 wherein said yoke and said handle members are unitarily formed of tubing and said handle members at said distance, the latter being substantially 20 to 24 inches.

10. The exercise aid of claim 1 wherein said neck bow is an arcuate member with a radius on the order of about 4 inches.

11. The exercise aid of claim 1 wherein said handle members extend parallel to a plane containing said neck bow.

12. The exercise aid of claim 1 wherein said handle members are of sufficient length to position the subject's hands substantially nine inches in front of the subject's anterior deltoid muscles during a sit-up movement.

* * * * *

UNITED STATES PATENT AND TRADEMARK OFFICE

CERTIFICATE OF CORRECTION

PATENT NO. : 4,863,158

DATED : September 5, 1989

INVENTOR(S) : Daniel R. Tassone

It is certified that error appears in the above-identified patent and that said Letters Patent is hereby corrected as shown below:

Col. 6, Line 8, after "members" please insert --are fixed--.

Signed and Sealed this

Twenty-fifth Day of December, 1990

*Attest:*

HARRY F. MANBECK, JR.

*Attesting Officer*

*Commissioner of Patents and Trademarks*